United States Patent [19]

Bottelsen

[11] 4,109,915

[45] Aug. 29, 1978

[54] BREAKAWAY DART

[76] Inventor: Walter Edward Bottelsen, 255 Brentwood Way, Goleta, Calif. 93017

[21] Appl. No.: 724,758

[22] Filed: Sep. 20, 1976

[51] Int. Cl.[2] ..... A63B 65/02

[52] U.S. Cl. ..... 273/106.5 R; 273/106.5 B; 273/106.5 C

[58] Field of Search ..... 273/106.5, 95 R; 43/6

[56] References Cited

U.S. PATENT DOCUMENTS

| | | | |
|---|---|---|---|
| 667,630 | 2/1901 | Kratz-Bojssae | 273/106.5 A |
| 2,616,201 | 11/1952 | Radiker | 43/6 |
| 2,796,691 | 6/1957 | Harris | 273/106.5 B X |
| 2,940,759 | 6/1960 | West | 273/106.5 B |
| 3,829,094 | 8/1974 | Goldfarb | 273/106.5 A X |
| 3,967,823 | 7/1976 | Yount | 273/106.5 B X |
| 3,976,298 | 8/1976 | Hinchman | 273/106.5 R |

FOREIGN PATENT DOCUMENTS

| | | | |
|---|---|---|---|
| 82,073 | 8/1919 | Switzerland | 273/106.5 B |

*Primary Examiner*—Paul E. Shapiro
*Attorney, Agent, or Firm*—Harry W. Brelsford

[57] ABSTRACT

A dart is made with a body that breaks away from the point upon impact and/or vanes or flights that break away from the body upon impact. The objective is to minimize the size of the embedded dart in a target so that subsequent darts can be thrown to the high score area of the prior darts. The breakaway is accomplished by relative movement upon impact between point and body and by the force of gravity breaking apart a magnetic hold between body and point. Springs are also used to separate the point and other parts and/or to hold the point in projected position during flight and to allow telescoping upon impact.

4 Claims, 13 Drawing Figures

20
21
22
23
24
26
27
28
30
31
32
33
34
36
37
38
39
41
42
43
44
46
47
48
49
51
52
53
54
55
56
57
58
59
61
62
63
64
65
A
B
II
III
V

BREAKAWAY DART

This invention relates to game darts and has particular reference to darts that break apart on impact so that a smaller mass of material remains on the game board. In this fashion subsequently thrown darts will have less deflection when they are thrown into the same area struck by a prior dart.

The game of darts has serious devotees, including national matches in some countries and international matches. National and regional champions are acknowledged with publicity that is accorded persons in other sports. A very proficient player can throw a number of darts into an area one-quarter of an inch square; this type of accuracy is required for the highest scores.

The bulk of a dart already embedded in the dart board and in the high score area presents a substantial problem to the player throwing subsequent darts. The flights, which correspond to feathers on an arrow, of an embedded dart occupy a substantial cross-sectional area in the flight path of subsequent darts, especially if the embedded dart is at an angle to the flight path. Furthermore, the body or barrel of a dart presents a sizable blockage to a high score area inasmuch as the diameter is generally in excess of one-quarter inch in diameter and may be one-half inch or greater.

To obviate these impediments to scoring so that the true skill of a dart player can be demonstrated, I have devised a dart that breaks away upon impact with the dart board, leaving only part of the dart attached to the board. In one form of my invention, only the point of the dart is left to mark the point of impact. In another form the flights are automatically dropped and the body or barrel remains attached to the board.

SUMMARY OF THE INVENTION

I provide a dart that has relatively movable parts in the direction flight. Upon impact with the board the point reduces its velocity upon penetration, and the continued relative movement of the other parts of the dart causes an uncoupling action, which mechanically disconnects various parts of the dart. In one form the flights fall off upon impact; in another the cane and flights are uncoupled and fall off; and in another version the body or barrel, cane, and flights all fall away from the point.

DESCRIPTION OF THE FIGURES

Various objects, advantages, and features of the invention will be apparent in the following description and claims, considered together with the drawings forming an integral part of this disclosure, in which:

FIG. 1A is an elevation view partly in section of a dart having a reciprocating point.

FIG. 1B is an elevation view partly in section of the dart in FIG. 1A after it has struck a target and the point has reciprocated in the body to eject the cane and flights.

FIG. 3A is an elevation view partly in section of a dart having a reciprocating point in a projected condition for flight.

FIG. 3B is an elevation view partly in section of the dart of FIG. 3A after it has impacted on a target ejecting the flights.

FIG. 5A is an elevation view partly in section of a dart having a reciprocating point in its projected position for flight.

FIG. 5B is an elevation view partly in section of the dart of FIG. 5A after it has struck the target and has ejected the cane and flights.

FIG. 7A is an elevation view of a dart having a point with an enlarged base which is frictionally engaged by an axial slot in the dart body.

FIG. 7B is an elevation view of the lower part of the dart of FIG. 7A after the dart has struck a target.

FIG. 11A is an elevation view partly in section showing a dart with a point held on by a magnet.

FIG. 11B is an elevation view of the lower part of the dart of FIG. 11A showing the parts broken away.

Referring to FIGS. 1A and 1B, a dart 20 has a body made of three principal parts, a point 21, a body or barrel 22, and flights 23. The point 21 has an enlarged base 24, which reciprocates in a cavity 26 in the body 22. Projecting upwardly from the base 24 is a stem 27 disposed in an axial bore 30. Fitting within the upper end of the axial bore 30 is a stem or cane 28, which connects the flights 23 to the body 22.

Figures 1, 2, 3, 4, 5, 6:
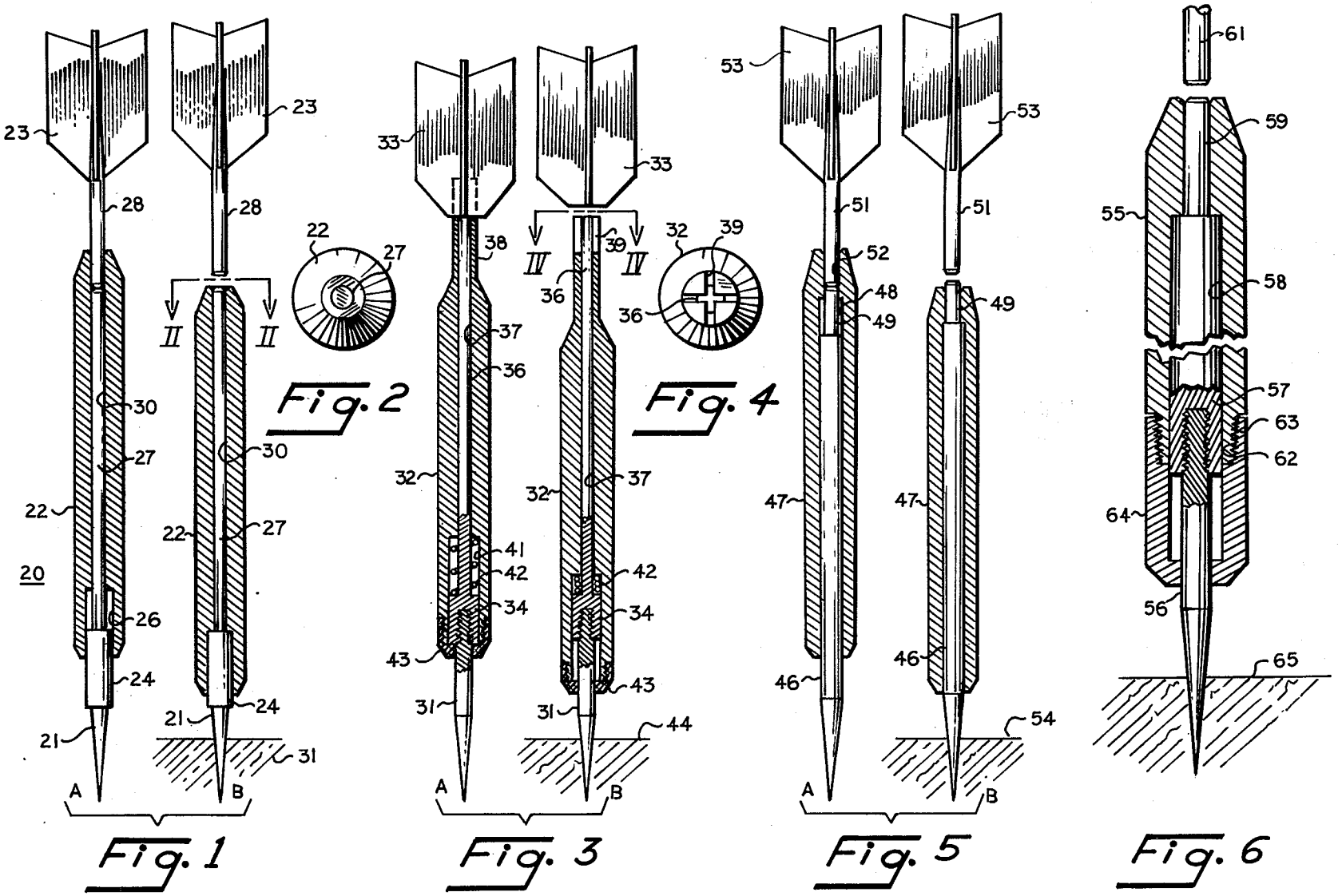
FIG. 2 is a sectional view on an enlarged scale along the line II—II of FIG. 1B.
FIG. 4 is an end view along the line IV—IV of FIG. 3B showing the slots in which the flights are placed.
FIG. 6 is a view on an enlarged scale in full section showing a dart having a collet-type arrangement for adjusting the friction on the reciprocating point in the body of the dart.

The relative position of the parts after the point 21 has impacted on a target 31 is shown in FIG. 1B. The barrel or body 22 has now moved downwardly with respect to the point base 24 to the position shown. This relative movement also causes the stem 27 to move toward the end of the bore 30, ejecting the cane 28 and the flights 23. This ejection of the flights is advantageous in that the flights fall away from the target area and do not impede the next shot, which in the normal line of play is made by the same person who has placed the preceding dart.

The dart of FIG. 1 depends on frictional engagement of the point base 24 with the cavity walls 26 to maintain the point in the projected position shown in FIG. 1A during acceleration and flight and which permits the base 24 to telescope within the cavity 26 upon deceleration upon striking a target.

Referring to FIG. 3A, there is illustrated a dart in which the point is maintained in a projected position by a compression spring. Again the three principal parts are present, a point 31, a barrel or base 32, and flights 33. The point 31 is threaded into an enlarged base 34 to which is connected an upwardly projecting stem 36, which reciprocates within a bore 37. The upper end of the body 32 is elongated at 38, and the upper end of this elongation has cross-slots 39 cut therein to receive the flights of 33 by a frictional engagement. The flights are similarly cross-shaped in cross section, and the lower end of the flights 33 rests against the upper end of the stem 36 in FIG. 3A. Referring now to the lower end of FIG. 3A, a compression spring is disposed within a cavity 41 within which the point base 34 reciprocates. Disposed in this same cavity is a compression spring 42, which presses against the point base 34 to urge the point to the projected position shown in FIG. 3. An encap 43 is threaded on the lower end of the body 32 to retain the assembly together.

Referring now to FIG. 3B, the position of the parts is shown after the dart has impacted upon a target 44. The body 32 has now moved downwardly with respect to the point 31, causing the bore 37 to move downwardly also, which causes the stem 36 to eject the flights 33, which have a cross shape fitting within the cross-slots 39 of FIG. 4. In this fashion the flights 33 are ejected and fall away from the target by gravity, thus not deflecting a subsequent shot of a player.

Referring to FIG. 5A, a point 46 reciprocates within a body 47 and is stopped by a shoulder 48 on an axial bore, and a stem 49 projects from the upper end of the point 46. A cane 51 fits within a bore 52, which is coaxial with the point 46. Flights 53 are connected to the cane 51. Friction maintains the point 46 in the projected position shown in FIG. 5.

When the dart of FIG. 5A strikes a target 54, the barrel 47 continues to move downwardly, causing the projecting stem 49 to eject the cane 51 and its flights 53 to thus reduce interference of subsequent shots to the target 54.

Referring to FIG. 6, there is illustrated a collet type of construction for precisely and accurately controlling the friction between a point and the body. A point 56 has an enlarged base 57 which reciprocates within a cavity 58 in a barrel or body 55. Projecting from the upper end of the point base 57 is a stem 59, which may eject a cane 61 in the same fashion as shown in FIGS. 1 and 5. The lower end of the body 55 has tapered threads 62 formed thereon, and this threaded lower end is radially slotted to form collet fingers 63. Threaded by a tapered thread on the lower end of the body 55 is a collet sleeve 64. When this sleeve 64 is rotated with respect to the body 55 the collet fingers 63 are forced inwardly to grasp or pinch the point base 57. The frictional control of the dart of FIG. 6 permits precise adjustment of the dart so that the point remains projected during acceleration and flight and readily reciprocates with the body 55 upon impact with a target 65.

Figures 7, 8, 9, 10, 11, 12, 13:
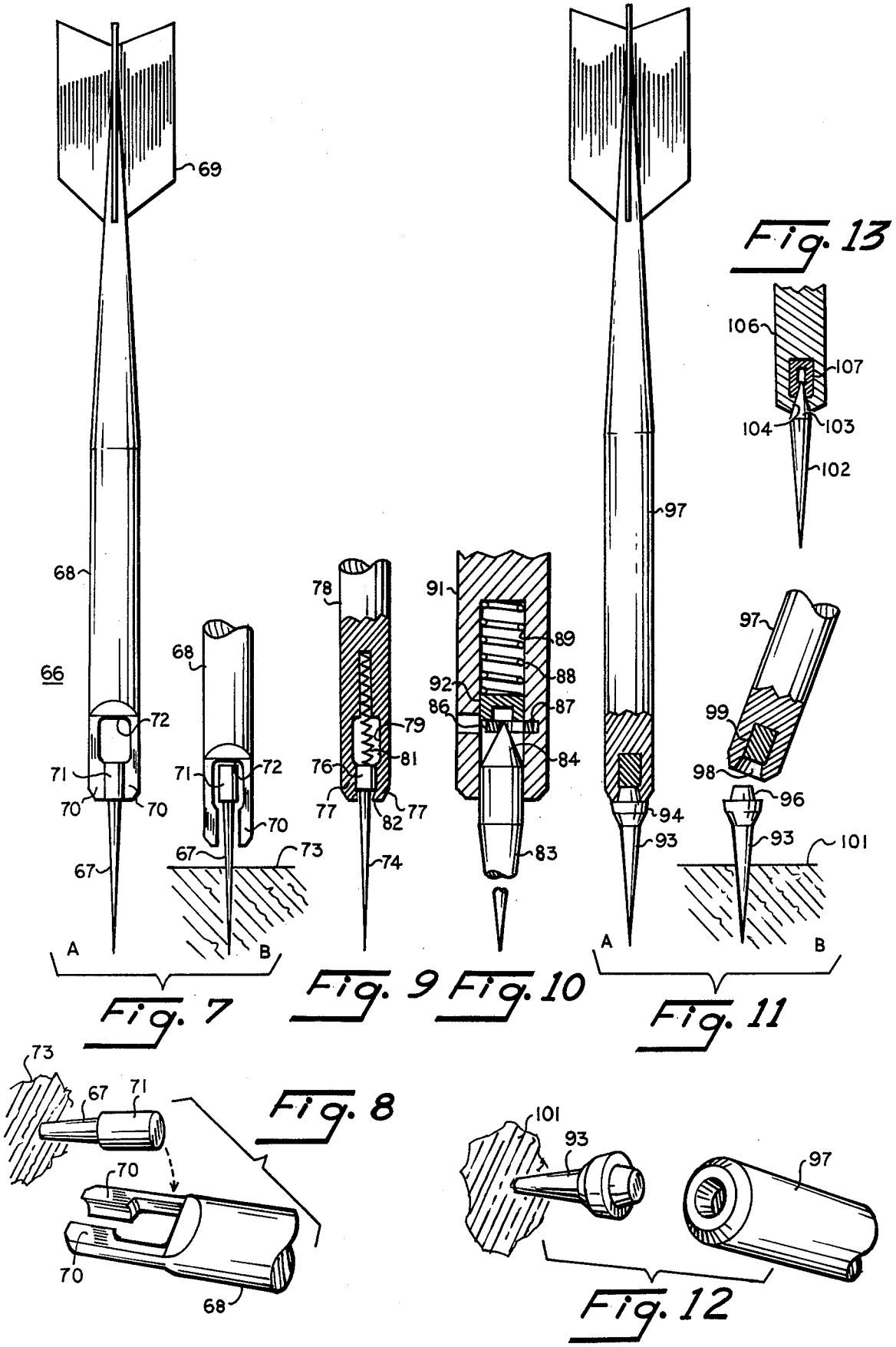
FIG. 8 is a three-dimensional view of the lower part of the dart of FIGS. 7A and 7B showing the point stuck in a target and the body or barrel falling away by gravity after impact.
FIG. 9 is a modified form of the dart of FIGS. 7 and 8 showing a compression spring for holding the point in its projected position, the figure being an elevation view mostly in section of the lower part of the dart.
FIG. 10 is an elevation view in full section on an enlarged scale of a dart wherein impact causes the point to release a trigger disk, which in turn releases a compression spring, which ejects the barrel of the dart away from the embedded point.
FIG. 12 is a three-dimensional view of the lower part of the dart of FIGS. 11A and 11B with the dart body falling away from the embedded point.
FIG. 13 is an elevation view in full section of a modified form of dart holding the point in place by a magnet.

Referring to FIG. 7A, there is illustrated a dart 66 having a point part 67, a body part 68, and a flight part 69. The point 67 may have a cylindrical base 71 which is frictionally engaged by a pair of fingers 70 formed by a partial bore through the lower end of the body 68 as shown best in FIG. 8. Rearwardly from the point 67 the lower end of the body member 68 has a radial slot 72 which is larger in transverse dimension than the point base 71. Accordingly, as shown in FIG. 7B, when the dart strikes a target 73 the body 68 moves downwardly on the point 67, disposing the point base 71 in this large radial slot 72 so that the dart body 68 will fall away from the point 67 as best shown in FIG. 8.

Referring now to FIG. 9, there is illustrated a structure similar to that of FIG. 7. A point 74 has an enlarged base 76, which is grasped by a pair of body fingers 77 similar to those illustrated in FIG. 8. A body member 78 has a radial slot 79 formed therein, which is larger in transverse dimension than the point base 76 so that the body 78 will fall away from the point 74 similar to the action shown in FIG. 8. The point of FIG. 8 is frictionally held in the position shown in FIG. 7A, and this friction is adjusted to allow the movement as shown in FIG. 7. In contrast the point of FIG. 9 uses a compression spring 81 to hold the point 74 in its projected position, and this compression spring urges the point base 76 against a restriction 82 at the bottom of the body 78. The spring is weak enough, however, to permit the telescoping action illustrated in FIG. 7B and FIG. 8.

Referring to FIG. 10, there is illustrated a construction wherein a spring is used to separate the body from the point. A point 83 has its upper end terminating in a cone 84, which is normally disposed adjacent to a trigger disk 86 held at one edge in a slot 87. A compression spring 88 in a bore 89 within a body member 91 urges a piston 92 downwardly against the point 83. Upon impact the body member 91 will move downwardly on the point 83, allowing the point cone 84 to slide the trigger disk 86 to the left as shown in FIG. 1, whereupon the compression of spring 88 is released to push against the point cone 84 and thereby separate the body 91 from the point 83.

Referring now to FIG. 11A, there is illustrated a dart having a point 93 having a shoulder 94 and a projecting shank 96. The point 93 fits in the lower end of a body member 97, which has a lower axial recess 98 that mates with the frustral conical shank 96 of the point 93. Disposed in the bottom end of the body 97 is a magnet 99, which holds the point 93 into its socket when the point or its shank 96 is made of a magnetic material. The body 97 will break away from the point 93 upon impact with a target 101 as best shown in FIG. 12.

Illustrated in FIG. 13 is a modified form of magnetic holding of a point wherein a point 102 has a conical upper end 103 fitting in a mating conical recess 104 and the lower end of a body member 106. Disposed inwardly of the conical hole 104 is a horseshoe magnet 107, which holds the point 102 in the position illustrated when the point is made of magnetic material. Upon impact in a horizontal fashion with a target as shown in FIG. 12, the body 106 will fall away from the embedded point 102.

Referring now to FIG. 1A, the point 21 is mechanically coupled to the body 22 by the base 24 fitting within the bore 26. The flights 23 are mechanically coupled to the body 22 by the cane 28 fitting within the bore 30. I provide uncoupling means in the form of relative movement of the cane 28 and the body 22. The uncoupling occurs when the cane 28 is forceably ejected from the bore. With FIG. 3 the flights are coupled to the body 32 by frictional engagement with the slots 39 (FIG. 4). The uncoupling means is the stem 36, which forces the flights out of the slots. The coupling and uncoupling mechanisms of FIG. 5 are similar to FIG. 1.

In FIG. 7 the mechanical coupling is the gripping of the point base 71 by the fingers 70. The uncoupling structure is the enlarged part of slot 72, which allows the body to fall away from the point 67. The coupling and uncoupling of the dart of FIG. 9 are similar to FIG. 7. The coupling means of FIG. 10 is the fit of the point 83 in the bore 89, and the uncoupling means includes the compressed spring 88. In FIGS. 11 and 13 the coupling is the magnetic force, and the uncoupling occurs by gravity acting against the magnetic force.

While I have described my invention with respect to presently preferred embodiments thereof, I do not limit myself to these embodiments as they are illustrative only and not restrictive. Accordingly, I include within the scope of the following claims all variations and modifications that fall within the true spirit and scope of my invention.

I claim:

1. A dart having a body that breaks away from a point upon impact with a target, comprising:

(a) an elongated dart point having a transverse dimension and having a base that has a transverse dimension and a longitudinal dimension;

(b) a dart body elongated along an axis;

(c) a pair of resilient fingers formed on one end of the body defining an axial slit having a transverse dimension greater than the point transverse dimension and less than the base transverse dimension, said fingers resiliently gripping the point base to yieldingly hold the point;

(d) and said body having a radial slot rearwardly of the base-gripping place of the fingers and intersecting the slit and having a dimension transverse of the body greater than the point base transverse dimension and having a longitudinal dimension greater than the longitudinal dimension of the base;

whereby the fingers frictionally hold the point during acceleration and flight and allow the body to move over the point upon impact with a target, so that the body falls free of the point.

2. A dart having flights that break away upon impact of the dart with a target, comprising (a) an elongated dart body having an axial bore, a point end and a flight end (b) flights yieldingly held to said flight end of said body and having a part projecting into the bore;

(c) said point end of said body being radially slotted to form collet fingers (d) a point yieldingly held to said point end of said body in said axial bore, but projecting therefrom, and between said fingers;

(e) an adjustable collet secured to the exterior of said body in the region of the fingers to cause the fingers to adjustably grip the point to hold the point in said projecting position during flight and to allow the body to move over the point upon impact with a target; and (f) a stem disposed in said bore with one end engaged by the point and the other end engaged by the flights; whereby impact of the dart on a target causes the body to overside the point, moving the stem rearwardly in the body to eject the flights from the body.

3. A dart that has a breakaway body upon impact with a target, comprising:

(a) a dart body having a bore in one end;

(b) a removable point disposed in the outer end of the bore and reciprocable in the bore and normally projecting from the body;

(c) a compressed spring disposed in the inner end of the bore and having expansion in a free state to contact the point to push the point and body apart;

(d) and trigger means engaging the spring and the dart body for retaining the spring in a compressed condition and having a part extending into the bore to be contacted by the inner end of the point;

said trigger being operated by the reciprocation of the point when the dart strikes a target to disconnect the trigger means from the body by the movement of the body toward the point, which allows the inner end of the point to contact the trigger means to operate the trigger.

4. A dart having a body that breaks away from a point upon impact with a target, comprising:

(a) a dart body elongated along an axis;

(b) a pair of fingers formed on one end of the body defining an axial slit having a transverse dimension;

(c) a stop at the forward end of the fingers to limit forward motion;

(d) an elongated dart point having a transverse dimension that is less than the transverse dimension of the slit and having a base that has a transverse dimension that is less than the transverse dimension of the slit and has a longitudinal dimension, said dart base being disposed between the fingers and the dart point projecting beyond the fingers;

(e) said body having a radial slot intersecting the slit and having a dimension transverse of the body greater than the point base transverse dimension and having a longitudinal dimension greater than the longitudinal dimension of the base;

(f) and a spring engaging the point base and the body for resiliently holding the point against the stop;

whereby the fingers and spring hold the point during acceleration and flight and the spring allows the body to move over the point upon impact with a target to dispose the point base within the radial slot so that the body falls free of the point.

* * * * *